United States Patent [19]

Uemura et al.

[11] Patent Number: 5,035,742

[45] Date of Patent: Jul. 30, 1991

[54] REDUCED CHROMIUM-ORE BEARING POWDER AND METHOD FOR PRODUCING THE SAME

[75] Inventors: Tadashi Uemura; Tsutomu Minagawa; Sadahiro Saito, all of Yamaguchi, Japan

[73] Assignees: Showa Denko K.K.; Shunan Denko K.K., both of Tokyo, Japan

[21] Appl. No.: 444,162

[22] PCT Filed: Mar. 9, 1989

[86] PCT No.: PCT/JP89/00256

§ 371 Date: Nov. 13, 1989

§ 102(e) Date: Nov. 13, 1989

[87] PCT Pub. No.: WO89/08724

PCT Pub. Date: Sep. 21, 1989

[30] Foreign Application Priority Data

Mar. 14, 1988 [JP] Japan ..... 63-59880

[51] Int. Cl.[5] ..... B01J 2/04

[52] U.S. Cl. ..... 75/623; 148/12; 423/626; 423/627; 423/629

[58] Field of Search ..... 75/623

[56] References Cited

U.S. PATENT DOCUMENTS 3,872,193 3/1975 Smith ..... 75/334

4,150,975 4/1979 Miyake ..... 75/623

*Primary Examiner*—Peter D. Rosenberg

*Attorney, Agent, or Firm*—Sughrue, Mion, Zinn Macpeak & Seas

[57] ABSTRACT

A reduced chromium-ore bearing powder used for production of a chromium-containing steel in a converter, is produced by a reduction of chromium ore-powder having a particle-diameter of 3 mm or less by a carbonaceous reducing agent having a particle diameter of 3 mm or less in an inert-gas atmosphere, while the chromium-ore powder and carbonaceous reducing agent are stirred and mixed with each other in the reaction chamber (5).

The reduced chromium-ore powder has 3 mm or less of particle diameter. Acid-soluble chromium is in an amount of 85% or more of the total chromium, and acid-soluble iron is in an amount of 95% or more of the total iron.

8 Claims, 3 Drawing Sheets

REDUCED CHROMIUM-ORE BEARING POWDER AND METHOD FOR PRODUCING THE SAME

DESCRIPTION

1. Technical Field

The present invention relates to a reduced chromium-ore bearing powder and a method for producing the same. More particularly, the present invention relates to a highly reduced chromium-ore bearing powder which is used for producing a chromium-containing steel, such as stainless steel, in a converter, and which is suitable for conveyance by carrier gas and is directly blown into the molten steel in the steel making process.

2. Background Art

Various methods have been devised for producing at low cost the chromium-bearing raw material of stainless steel. Merits and demerits of such methods are greatly influenced by the conditions of raw materials and electric power and by condition of location of a smelting plant. It is crucial, in Japan for example, to effectively utilize powdered chromium ore which has a poor grade, in order to minimalize production costs.

Incidentally, developments are being made on how to produce a stainless steel by means of blowing chromium-ore powder into an oxygen top-and/or bottom-blowing converter for steel making. Fundamental reaction in a converter oxidizes and removes carbon contained in molten pig iron with the aid of oxygen. Combustion heat is obtained by the oxidation and is utilized to elevate the temperature of molten steel. Upon injection of the chromium-ore powder into the molten steel, the chromium ore must not only be melted but also be reduced. Chromium ore must be first melted, and then the reduction of chromium ore occurs in the molten state. Heat source is indispensable for melting and reduction. A carbonaceous agent is usually added into a converter, and is utilized as both a reducing agent and heat source. In order that combustion of the carbonaceous agent take place, oxygen is necessary, with the result that the amount of oxygen blown increases, and the refining time becomes considerably longer. In a more metallurgical aspect, the addition of a carbonaceous agent into a converter necessitates simultaneous oxidation (combustion) of carbon and reduction of ore. There is a limitation as to whether both the oxidation and reduction reactions can proceed in an identical converter. In order to thoroughly reduce the chromium ore in a converter, the amount of reducing agent is considerably excessive more than the chemical equivalent amount for reducing the chromium ore added in a converter, with the result that productivity is decreased and cost is increased. In most of the steel making plants, a continuous-continuous casting is carried out. In this case, refining time matches casting time. When a carbonaceous reducing agent is added into a converter, the continuous-continuous casting is carried out with difficulty, with the result that such disadvantages as decrease in productivity and recovery and increase in labor are incurred.

Blowing of reduced chromium-ore bearing powder appears to overcome the difficulties involved in the addition of chromium ore. The following methods for producing the reduced chromium-ore bearing powder are known.

(1) Chromium ore, carbonaceous reducing agent and binder are agglomerated into pellets having appropriate size and strength and are reduced by heating in inert atmosphere (Japanese Examined Patent Publication No. 38-1959).

(2) Raw materials in the form of powder are stirred in a furnace which is equipped with inner burners for the combustion of hydrocarbonaceous fuel (U.S. Pat. No. 2,582,469).

(3) Raw materials in the form of powder are reduced by means of introducing hydrocarbonaceous gas therethrough (Japanese Unexamined Patent Publication No. 59-179725).

In method (1), in which pellets are produced and then reduced, the raw materials in the form of powder must intentionally be once pelletized and subsequently be again crushed to obtain powder. The production of pellets and crushing is complicated and results in increase in cost. In addition, in order to fulfill the certain strength requirement of the pellets, limitations are imposed upon the raw materials and production methods of pellets, and hence result in increase in cost.

In method (2), in which by use of inner burners, combustion of the hydrocarbonaceous fuel takes place, the inner atmosphere of a furnace contains an oxidizing stream, such as $CO_2$ formed due to combustion by the burners. In the case of pellets, only their surfacial parts are re-oxidized and hence a certain degree of reduction, for example 80%, is obtained. In the case of powder, since it has a large specific surface area, the extent of re-oxidation becomes higher, and hence the reduction degree remains low, for example 60% at the highest.

In method (3), in which the reducing gas and chromium in the form of powder are brought into contact, the reduction occurs in a gas phase-solid phase reaction. In order to thoroughly bring the gas and powder into contact with one another, the ore must be fluidized satisfactorily, with the result that the construction of a plant becomes complicated, and further, the temperature cannot be elevated to a high level. The reduction degree is accordingly suppressed at a low level. In addition, since the hydrocarbon is expensive, the cost is increased.

DISCLOSURE OF INVENTION

It is an object of the present invention to provide a reduced chromium-ore bearing powder which has a high content of reduced chromium and incidental iron, and is hence suitable for adding into a converter, in which the oxidation with pure oxygen is the predominant reaction.

It is another object of the present invention to provide a method for producing a reduced chromium-ore bearing powder, wherein a high reduction degree is attained without incurring increase in cost, as compared with the known methods.

In accordance with the objects of the present invention, there is provided a reduced chromium-ore bearing powder used for production of a chromium-containing steel in a converter, which powder essentially consists of a reduced-chromium ore and free carbon, wherein said reduced chromium-ore essentially consists of an acid-soluble chromium, a chromium oxide, an acid-soluble iron, an iron oxide, and gangue material, and, further the reduced chromium-ore powder has 3 mm or less of particle diameter, the acid-soluble chromium is in an amount of 85% or more of the total chromium, and the acid-soluble iron is in an amount of 95% or more of the total iron.

In accordance with the present invention, there is also provided a method for producing a reduced chromium-ore bearing material by means of reducing chromium ore with a carbonaceous reducing agent, characterized by: stirring and mixing the chromium ore having a particle diameter of 3 mm or less and the carbonaceous reducing agent having a particle diameter of 3 mm or less, in an amount of at least equal to the equivalent amount for reducing the chromium oxide and iron oxide contained in the chromium ore; and, heating the chromium ore and carbonaceous reducing agent to a temperature of from 1200° to 1500° C. in an inert gas-atmosphere, while said chromium ore and carbonaceous reducing agent are stirred and mixed.

The stirring and mixing is preferably carried out in a rotary furnace which comprises the following rotary members capable of rotating therewith and being integral therewith: a reaction chamber located at the center of the rotary furnace and defined by polygons in cross section made of heat resistant ceramics; and, a plurality of heating-gas chambers formed around the reaction chamber.

BRIEF DESCRIPTIONS OF DRAWINGS

BEST MODE FOR CARRYING OUT THE INVENTION

Figure 3:
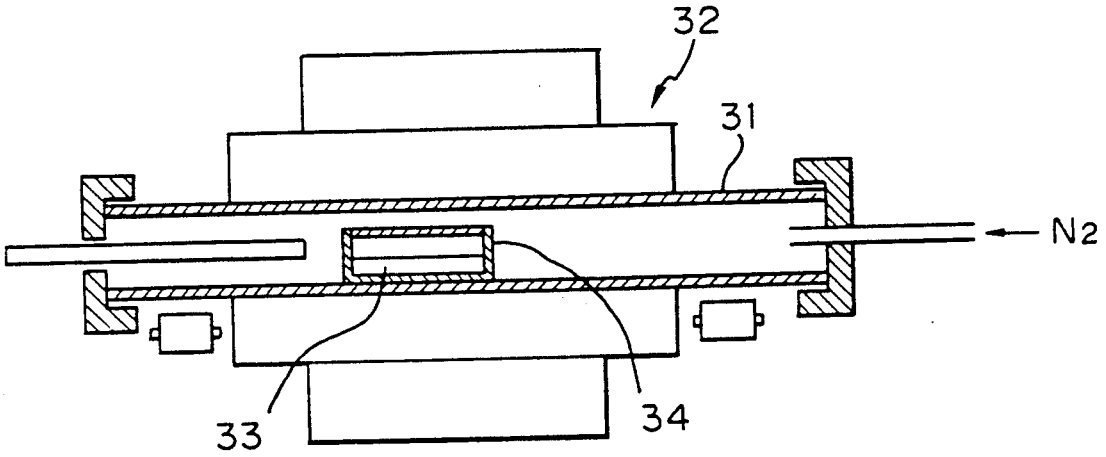
FIG. 3 shows an experimental furnace.

The present inventors carried out experiments by using the heating device as shown in FIG. 3. A gas-tight reaction chamber 31 is rotatably mounted in a furnace 32. Into a tubular crucible 34 made of graphite was charged two kinds of raw materials 33. One kind was a mixture of chromium ore and powder cokes, both having particle diameter of 3 mm or less. The compositions of chromium ore and powder cokes are given in Table 1, below. The other kind was prepared by crushing the chromium ore and powder cokes having the same compositions as the one mentioned above to 90% passing through 150 mesh, adding binder to the powder, and agglomerating the powder to pellets 2.4 cm in diameter. Nitrogen gas was passed through the core chamber 31 to create the inert atmosphere. Heating was carried out to attain an inner temperature of 1300° C. or more. For each of the raw materials, the reaction chamber 31 was rotated and kept stationary, so as to investigate the influence of rotation on the speed of reduction reaction. The reduction degree of the chromium (%) are shown in Table 2.

TABLE 1

| | $Cr_2O_3$ | FeO | Fixed Carbon | Volatile Matters | Ash | Gangue |
|---|---|---|---|---|---|---|
| Chromium ore | 45.7 | 25.4 | — | — | — | 28.0 |
| Coal | — | — | 57.3 | 34.7 | 8.0 | — |
| Cokes | — | — | 87.5 | 1.5 | 11.0 | — |

TABLE 2

| | | Reaction Time (hrs) | | | |
|---|---|---|---|---|---|
| | | 20 | 40 | 60 | 80 |
| Powder Raw Materials | Stationary | 6.0 | 13.5 | 18.7 | 25.3 |
| | Stir | 47.1 | 60.5 | 68.8 | 74.7 |
| Pellets | Stationary | 60.5 | 74.7 | 82.4 | 87.3 |
| | Stir | 61.8 | 73.9 | 80.3 | — |

As is shown in Table 2, the reaction speed is high both in the stirring case and the stationary case when using the pellets, while when raw materials in the form of powder are used, the reaction speed is very slow in the stationary case but is as high as the pellets in the stirring case. The present invention is based on this discovery.

Various gases may be employed for creating the inert atmosphere in the furnace. However, it is not necessary to blow particular gas into the furnace. When the reaction is carried out in a closed furnace, the CO gas formed as a result of the reaction can create the inert atmosphere.

Means for heating the furnace may be any appropriate one which does not cause oxidation in the furnace-interior, such as installing electric heaters within a closed furnace, or indirectly heating the furnace by means of external burners. In the latter method of indirect heating, since the temperature required for reducing the chromium ore is rather high, it is considerably difficult to construct a furnace which exhibits enough strength to reach a sufficiently high temperature for stirring the chromium ore. For the indirect heating, a rotary furnace which comprises the following rotary members capable of rotating therewith and being integral therewith is recommended: a reaction chamber located at the center of the rotary furnace and defined by polygons in cross section made of heat resistant ceramics; and, a plurality of heating-gas chambers formed around the reaction chamber.

A reduced chromium-ore bearing powder according to an embodiment of the present invention contains free carbon in an amount of from 3 to 10% by weight based on said powder.

A reduced chromium-ore bearing powder according to another embodiment of the present invention contains the total chromium in an amount of from 22 to 48% by weight and the total iron in an amount of from 11 to 24% by weight of said powder.

The particle diameters of the raw materials of chromium ore and the reduced chromium ore as well as the carbonaceous reducing agent are 3 mm or less, because the reduced chromium-ore bearing powder, according to the present invention, is produced by a reduction of chromium ore-powder while it is in contact with the carbonaceous reducing agent during the stirring and mixing in the furnace, and hence the contact area between them must be kept high. The temperature is limited to a range of from 1200° to 1500° C., since at a temperature below 1200° C. reduction of chromium oxide does not progress sufficiently, and, further, at a temperature above 1500° C. the chromium ore softens and sticks to the inner wall of a reaction chamber, thereby making operation difficult.

When the reduced chromium-ore bearing powder is blown into the molten steel of a converter, since major parts of chromium and iron have been converted to an acid-soluble state, that is chromium-iron carbide, chromium and iron are melted in the molten pig iron or steel and form a homogeneous alloy without undergoing any reduction. An excessive quantity of heat for reduction reaction is therefore unnecessary. It is also possible to decrease the carbon additive and the oxygen in the converter, because the reduction degree in the reduced chromium-ore bearing powder is high. In this regard, the free carbon remaining unoxidized in the reduced chromium-ore bearing powder plays the role of the carbon additive and thus allows the decrease of the carbon additive. Furthermore, the extension of refining time in the converter due to the addition of chromium-bearing material can be minimalized.

According to the method of the present invention, the chromium ore in the form of powder and carbonaceous reducing agent in the form of powder are mixed and stirred with each other under inert atmosphere at an appropriate temperature. That is, the reduction reaction proceeds under inert atmosphere while the chromium-ore powder and carbonaceous powder are mixed and stirred with each other. High reduction degree is attained in the powder state of chromium ore such that 85% or more of the total chromium is converted to chromium carbide, that is acid-soluble chromium. Reduction of iron proceeds preferentially as compared with the chromium reduction and 95% or more of the total iron is converted to iron carbide, that is, acid-soluble iron. Since the raw materials in a powder form are used in the present invention, neither a pre-agglomerating process nor a post-crushing process are required at all. The chromium source provided by the present invention has a high degree of reduction and is inexpensive.

Figure 1:
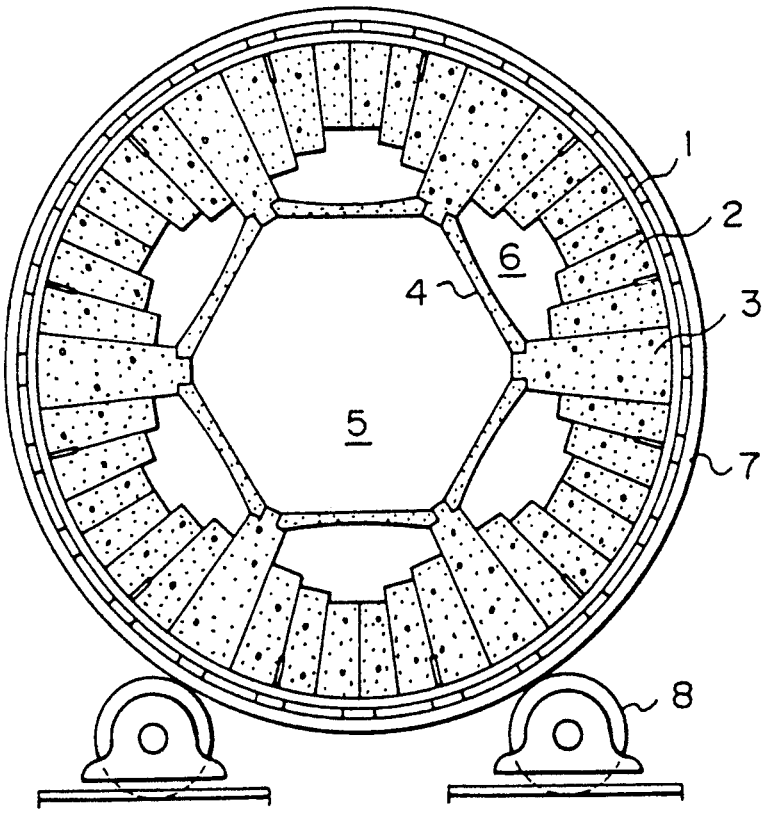
FIG. 1 is a lateral cross-sectional view of an example of an external heating, rotary furnace used for carrying out the present invention.
Figure 2:
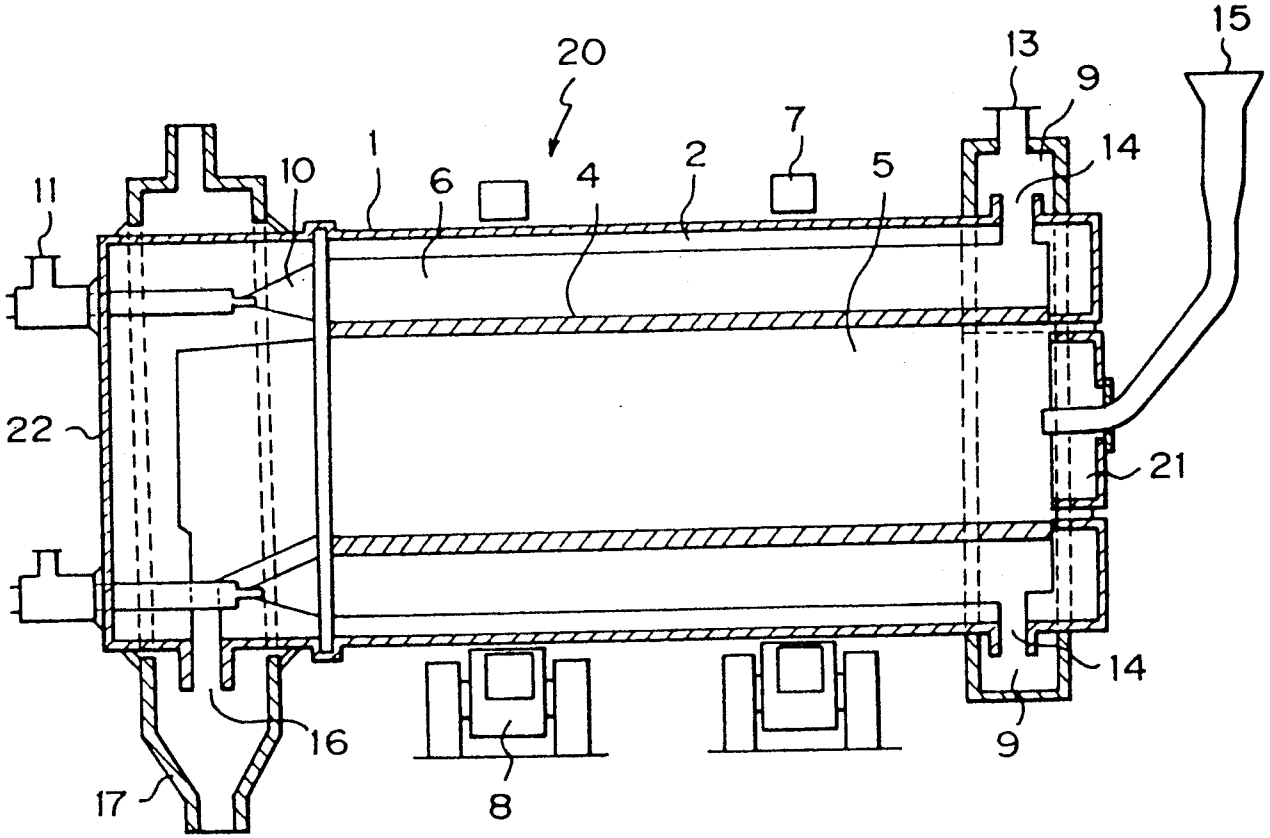
FIG. 2 is a longitudinal cross-sectional view of FIG. 1.

The present invention is further described with reference to FIGS. 1 and 2 illustrating an external heating, rotary furnace.

Referring to FIG. 1, an embodiment of the external heating type rotary furnace according to the present invention is shown at a vertical cross section with respect to a rotary axis. Referring to FIG. 2, the identical furnace is shown at a cross section parallel to the rotary axis.

Heat-insulative bricks 2 are radially lined around the inner surface of the cylindrical steel mantle 1.

Height of the heat-insulative bricks 2 is not uniform around the steel mantle 1, but, the supporting bricks 3 are located at an appropriate distance therebetween, e.g., every seventh brick in the embodiment shown in FIG. 1. The supporting bricks 3 support the ceramic plates 4 which are partition walls of the heating-gas chambers 6. A reaction chamber 5 having polygonal form in cross section is therefore surrounded and defined by the ceramic plates 4 and supporting bricks 3. In addition, a plurality of heating-gas chambers 6 are formed around the reaction chamber 5 by the heat-insulative bricks 2, supporting bricks 3, and ceramic plates 4.

The rotary furnace body 20 is supported by rollers 8 via rings 7 and is driven by a power source (not shown) to make it rotate. The combustion furnace 22 and panels 21 are connected with the rotary furnace body 20 to form an integral structure. Namely, the rotary furnace body 20, combustion furnace 22, and panels 21 as a whole constitute an integrally rotary furnace body.

The rotary furnace body 20 is supported aslant in such a manner that the end beside the panels 21 is elevated and forms a slight angle to the horizontal plane. Pipes for feeding fuel and air are connected to the burners 11 via universal joints not shown. The burners 11 are rotated together with the rotary furnace body 20.

Since the reaction chamber 5 and heating-gas chambers 6 are constructed as above, when the steel mantle 1 is rotated, they (5 and 6) are rotated integrally with the rotation of steel mantle 1.

High temperature gas obtained in the combustion chamber 10 is passed through the heating-gas chambers 6 of the rotary furnace body 20, which is opposite the combustion chamber 10. The high temperature gas heats the ceramic plates 4 of the partition walls while passing through the heating gas chamber 6, and, after passing through exhaust gas prt 14, is collected in exhaust gas-chamber 9, and is evetually let out of the outside heating system through an exhaust gas-outlet 13. Meanwhile, materials to be treated are fed through the raw materials supplying port 15 to the reaction chamber 5 and are then subjected to rotary traveling in the reaction chamber 5, while being indirectly heated by combustion gas which is isolated from the materials. These materials now the (finished) product, are then withdrawn, from the reaction chamber 5 through the product-outlet 16 provided on the lower part of the combustion furnace 22. The product is then collected via chute 17 and withdrawn.

For the heat-insulative brick, bricks having low heat conductivity are used so as to attain the smallest external dissipation of heat through the steel mantle. For practical purposes, conductivity ($\lambda$) of heat-insulative bricks is from 0.10–2.0 kcal/m.h. ° C. (1000° C.), preferably 0.1–0.5 kcal/m.h. ° C. Heat-insulative bricks may be porous, e.g., have porosity ranging from 60 to 70%. The heat-insulative bricks may be constructed in dual layers.

Since the supporting bricks 3 are used for supporting the ceramic polygon, high strength bricks should be used, even if it entails a sacrifice of slight heat conductivity. Preferred bricks for the supporting bricks are those based on schamotte and alumina. Brickwork of the heat-insulative bricks 2 may be performed with the use of castable refractory.

The ceramics which form the polygon should have strength able to withstand a high temperature of 1400° C. or more and a high heat conductivity, and should not be affected by combustion gas at a high temperature. Materials satisfying these requirements are ceramics, such as silicon carbide, aluminum nitride, alumina, and the like. Silicon carbide is particularly preferred, since large sized sintering products are available. Sintered silicon carbide exhibits a heat conductivity of 10 kcal/m.h. ° C. or more (at 1000° C.), compression strength (bending strength) of 200 kg/cm$^2$ (at 1300° C.) or more, and is characterized as having high strength and high heat-conductivity. such strength is satisfactory for supporting the load of the charged materials, when exposed to combustion gas stream.

In an example described hereafter a furnace constructed as described above was used. The specifications of the furnace were: inner diameter of iron mantle—1300 mm; length of iron mantle—11 m; rotation number—0.12 rpm; fuel of burners— heavy oil; the highest temperature of the reaction wall —1475° C.: and, the length of a region of the reaction wall having a temperature of 1200° C. or more—7 m.

The powdered, chromium ore, cokes and coal having the compositions as shown in Table 1 were weighed and blended in such a manner that the amount of carbon is the same as that required for reducing 100% of the chromium ore. The raw materials were charged through the inlet port into the reaction chamber 5. The raw materials were rotated and stirred together with the rotation of rotary furnace body 20. The raw materials were mixed and successively displaced through the reaction chamber toward the outlet port 16 for withdrawing the product. During the displacement, the raw materials were heated by direct contact with the partition wall made of ceramic plates 4 and by radiation heat. The chromium ore in the form of powder and carbonaceous reducing agent were forced to come in contact with one another by the stirring. The points of contact were renewed due to the stirring. The reduction reaction proceeded between the solid phases at the contact points where the temperature rose to 1000° C. or more.

The staying time of raw materials in the above described external heating, rotary furnace was 6.8 hours. A total of 1.4 tons of sum of the raw materials were treated per hour. The raw materials were heated to a temperature of 1200° C. or more for 1.9 hours in staying time. The chemical analysis of the resultant products is shown in Table 3. The reduction degrees of iron and chromium were 99% and 88.2%, respectively.

In comparison, the same reduction treatment as above was carried out with the pellets. The pellets were prepared by finely crushing the raw materials weighed and blended as described above to a size where 90% or more pass through 200 mesh. Bentonite and water were added to the powder, which was then pelletized to a diameter of 5 to 20 mm, followed by drying. The reduction degree of iron and chromium were 97.8% and 93.6%, respectively, as shown in Table 3.

TABLE 3

| | T.Cr | Sol.Cr | T.Fe | Sol.Fe | T.C | RR |
|---|---|---|---|---|---|---|
| Inventive | 34.0 | 30.0 | 22.5 | 22.3 | 6.9 | 0.924 |
| Comparative | 34.4 | 32.2 | 22.6 | 22.1 | 4.8 | 0.949 |

RR = (A/B) × 100(%)
A = (Sol.Cr)/34.67 + (Sol.Fe)/55.85
B = (Total.Cr)/34.67 + (Total.Fe)/55.85

INDUSTRIAL APPLICABILITY

The reduced chromium-ore bearing powder according to the present invention can be used for producing stainless steel and other chromium-containing steel in a converter other metallurgical vessel where the predominant reaction is oxidation. When a reduced chromium-ore bearing material having a high reduction degree according to the present invention is charged in a converter, a reduction reaction can be avoided.

In the method of the present invention, pelletizing is unnecessary. Heat sources used in the present invention may be heavy oil or other fuels as well as electric power. Therefore, the method according to the present invention is appropriate for producing at a low cost a reduced chromium-ore bearing powder having a high degree of reduction.

We claim:

1. A reduced chromium-ore bearing powder used for production of a chromium-containing steel in a converter, which powder essentially consists of a reduced-chromium ore, and free carbon, wherein said reduced chromium-ore essentially consists of an acid-soluble chromium, a chromium oxide, an acid-soluble iron, an iron oxide, and gangue material, and, further said reduced chromium-ore powder has 3 mm or less of particle diameter, said acid-soluble chromium is in an amount of 85% or more of the total chromium, and said acid-soluble iron is in an amount of 95% or more of the total iron.

2. A reduced chromium-ore bearing powder according to claim 1, wherein said free carbon is in an amount of from 3 to 10% by weight based on said powder.

3. A reduced chromium-ore bearing powder according to claim 2, wherein the total chromium is in an amount of from 22 to 48% by weight and the total iron is in an amount of from 11 to 24% by weight of said powder.

4. A reduced chromium-ore bearing powder according to any one of claims 1 through 3, wherein it is produced by a reduction of chromium ore-powder having a particle-diameter of 3 mm or less by a carbonaceous reducing agent having a particle diameter of 3 mm or less in an inert-gas atmosphere.

5. A reduced chromium-ore bearing powder according to claim 4, wherein said chromium-ore powder and said carbonaceous reducing agent are stirred and mixed with each other during the reduction.

6. A method for producing a reduced chromium-ore bearing material by means of reducing chromium ore with a carbonaceous reducing agent, comprising: stirring and mixing said chromium ore having a particle diameter of 3 mm or less and said carbonaceous reducing agent having a particle diameter of 3 mm or less, in an amount at least equal to the amount needed for reducing the chromium oxide and iron oxide contained in the chromium ore; and, heating said chromium ore and carbonaceous reducing agent to a temperature of from 1200° to 1500° C. in an inert-gas atmosphere, while said chromium ore and carbonaceous reducing agent are stirred and mixed.

7. A method for producing a reduced chromium-ore bearing material according to claim 6, wherein said stirring and mixing is carried out in a rotary furnace which comprises the following rotary members capable of rotating therewith and being integral therewith: a reaction chamber (5) located at the center of the rotary furnace (20) and defined by polygons in cross section made of heat resistant ceramics (4); and, a plurality of heating-gas chambers (6) formed around the reaction chamber (5).

8. A method according to claim 6 or 7, wherein said inert-gas atmosphere is a CO gas atmosphere which is formed as a result of the reaction between said chromium ore and said carbonaceous reducing agent.

* * * * *